US005568923A

United States Patent [19]

Kahn et al.

[11] Patent Number: 5,568,923

[45] Date of Patent: Oct. 29, 1996

[54] ROLLER HOCKEY PUCK

[76] Inventors: Jon B. Kahn, 3002 Stargrass Ct., League City, Tex. 77573; Todd J. McCusker, 16002 Copper Canyon, Friendswood, Tex. 77546

[21] Appl. No.: 572,880

[22] Filed: Dec. 18, 1995

[51] Int. Cl.[6] ..... A63B 71/02

[52] U.S. Cl. ..... 273/128 A; 273/128 R

[58] Field of Search ..... 273/126 R, 128 R

[56] References Cited

U.S. PATENT DOCUMENTS

| | | | |
|---|---|---|---|
| 2,727,744 | 12/1955 | Watson | 273/128 R |
| 3,090,109 | 5/1963 | White et al. | 29/201 |
| 3,784,204 | 1/1974 | Felber | 273/128 R |
| 4,218,062 | 8/1980 | Brooks, Jr. | 273/128 R |
| 4,793,769 | 12/1988 | DeLan | 273/128 R |
| 4,801,144 | 1/1989 | DeMasi, Jr. et al. | 273/128 R |
| 5,240,251 | 8/1993 | Filice | 273/128 R |
| 5,275,410 | 1/1994 | Bellehumeur, et al. | 273/128 R |
| 5,429,360 | 7/1995 | Capecci, Jr. | 273/128 R |

*Primary Examiner*—Mark S. Graham
*Attorney, Agent, or Firm*—Marvin J. Marnock

[57] ABSTRACT

A hockey puck (10) for playing roller hockey on a non-ice surface. The puck includes a puck body (12) of circular cylinder configuration in which a minimum of three multi-directional roller wheel assemblies (20) are mounted in symmetrical equiangular relationship about the puck center. Each wheel assembly comprises a cylindrical wheel support body (21) mounted for rotation on a central main axle (22) parallel to the planar slide surfaces (14, 16) of the puck. Each wheel assembly (20) includes at least one set of wheels (30), each wheel journalled for rotation on its own individual axle (32) mounted in a plane perpendicular to the main axle of the wheel assembly. Each wheel support body (21) has a circular cylinder outer surface (27) of a diameter greater than the thickness of the puck body and each wheel (30) in a set has a roller surface (30*a*) which in a cross section co-planar with the axes of all wheels in the set describes an arc with radius of curvature which exceeds the radial distance of the cylindrical outer surface of the wheel support body (21) from its main axle (22) and is concentric with arcs described by the other roller surfaces in the set, said plurality of wheel assembles thereby allowing a rolling action of at least one of the wheels (30) whenever a force is applied to the puck with a force component parallel to the playing surface.

9 Claims, 3 Drawing Sheets

ROLLER HOCKEY PUCK

The present invention relates to hockey pucks and more particularly to a puck designed for use on non-ice planar surfaces such as concrete, asphalt or roller rink surfaces.

BACKGROUND OF THE INVENTION

A variety of hockey pucks have been developed for use in roller hockey, a game played on hard non-ice surfaces by players on roller skates, usually in-line roller skates. These pucks are designed to minimize friction between the puck and the playing surface and to otherwise simulate the behavior of a hockey puck as is used in the game of ice hockey. In spite of these developments, the game of street hockey suffers in comparison with the game of ice hockey because of the inadequacy of the puck in reducing friction with the relatively rough non-ice surface and the debilitating effects on the puck which derive from extensive use.

Several previously patented designs have attempted to overcome such deficiencies by employing roller balls embedded in the body of a puck. However, several problems are systemic to this strategy. The ball gives little mechanical advantage in terms of reducing friction since the surface of the ball when rolling must also slide against the inner wall of the puck body in which it is embedded. Also, the friction of the balls with the inner walls is increased by the inevitable toughening of the balls' surfaces which accompanies usage. Further, the balls are constantly accumulating debris from the street and transferring it to the space between the balls and the puck body, thereby decreasing performance still further.

In contrast to a ball mounted in a puck body, the simple wheel presents advantages in terms of the leverage provided by the difference in wheel diameter and the wheel axle diameter. But since the simple wheel can roll in only one direction, although reversible, it does not solve the problem presented by the requirement that the puck must be free to travel in any direction immediately upon being contacted with the hockey stick, even though multiple wheels may be provided. In addition, the provision of castors for the puck body is unsatisfactory because of the characteristic behavior of castors in having to re-direct themselves depending on the direction of travel which makes for an undesirable motion of the puck when being re-directed.

SUMMARY OF THE INVENTION

The present invention relates to a hockey puck which is suitable for playing hockey on a non-ice surface. The puck includes a puck body in which a minimum of three multi-directional wheel assemblies are mounted in symmetrical equiangular relationship about the puck center. Each roller wheel assembly comprises a wheel support body mounted for rotation on a main axle which, in a preferred embodiment, extends in a central plane which is parallel to the planar slide surfaces of the puck. Each roller wheel assembly further includes at least one set of wheels, preferably four to a set, wherein the wheels of a set are each journalled for rotation on its own individual axle, such wheel axles being mounted on a plane perpendicular to the main axle of the wheel assembly.

The puck body is also provided with a plurality of single-directional edge rollers which are adapted to minimize friction on the leading edge of travel while the puck is tipped up on its trailing side and the leading edge is between wheel assemblies. Each edge roller is mounted on an axle which is press-fit into the puck body at a location between a pair of adjacent wheel assemblies and is disposed such that the edge rollers do not contact the playing surface when the puck body is lying flat thereon.

The plurality of these multi-directional wheel assemblies mounted on axles in the body of the puck, allows rolling action of a combination of wheel assemblies and wheels when the puck is pushed in any direction parallel with the ground. When forces acting on the puck are perpendicular to a main axle of a wheel assembly and parallel to the playing surface, that wheel assembly rolls on its main axle. When the forces are parallel to the axle, the rolling is instead taken by whichever wheel happens to be contacting the ground at that time. When the force is at any angle between the two mentioned, a combination of main wheel assembly rolling and wheel rolling occurs.

DETAILED DESCRIPTION OF THE INVENTION

Figure 1:
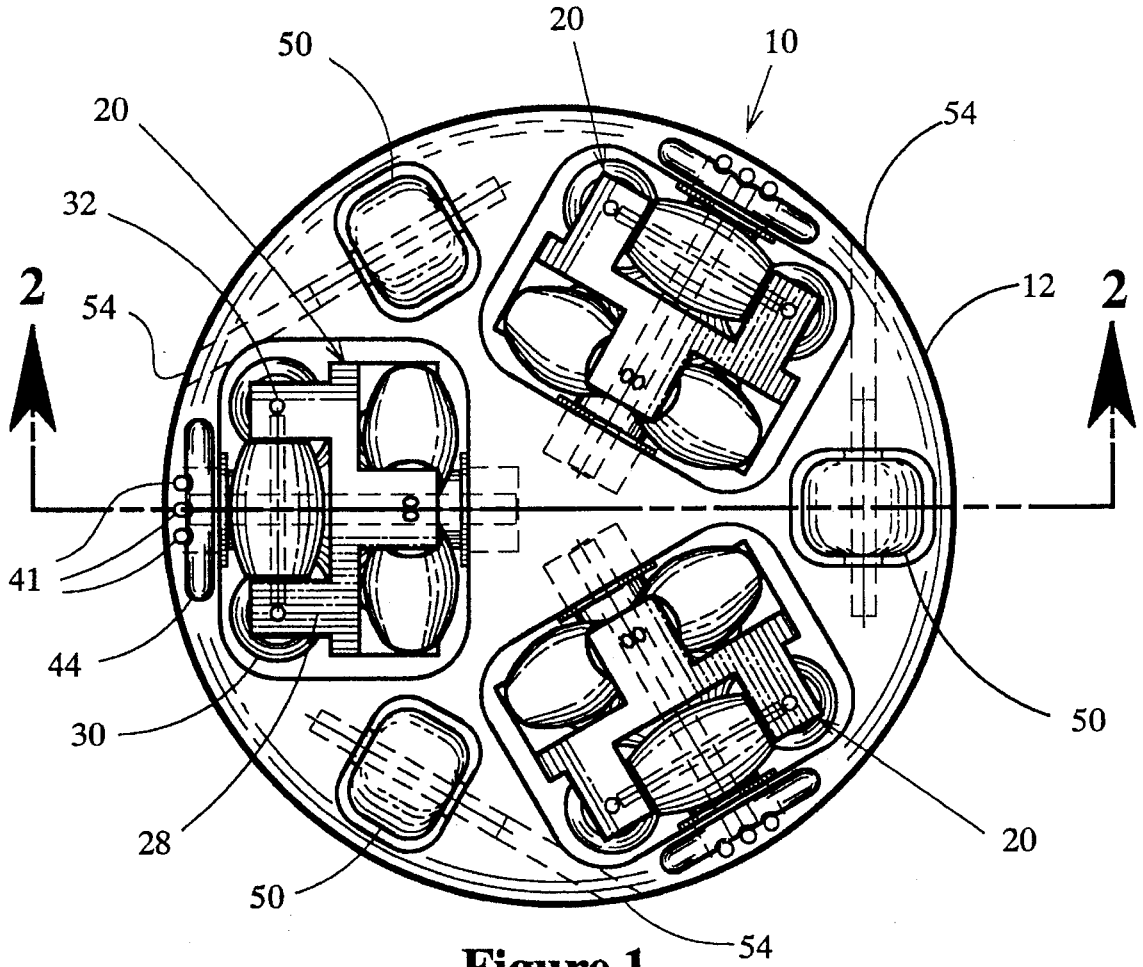
FIG. 1 is a top plan view of a hockey puck which represents a preferred embodiment of the invention.
Figure 7:
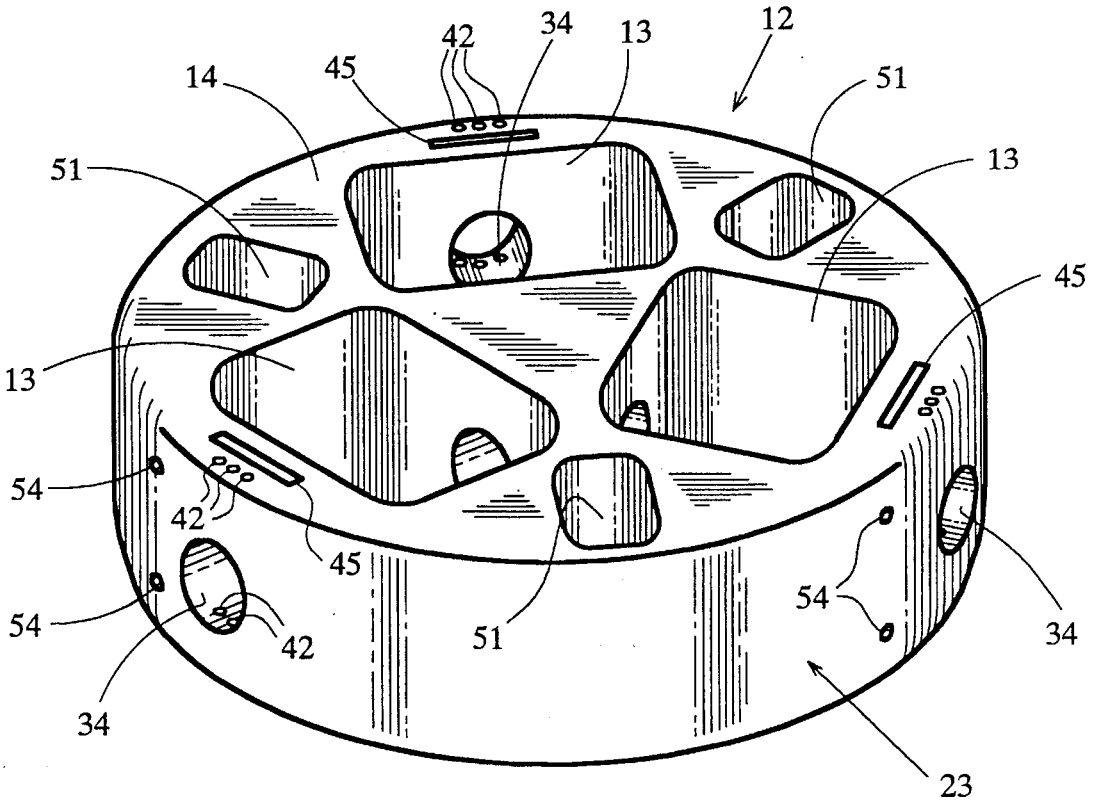
FIG. 7 is a view in perspective of the puck body to which multi-directional wheel assemblies are mounted in accordance with the invention.

Referring more particularly to the drawings, there is shown in FIG. 1 the top view of a hockey puck 10 representing a preferred embodiment of the invention. The puck 10 comprises a puck body 12 formed in a disc-like circular cylinder configuration with planar end surfaces 14 and 16. The puck body 12, shown in perspective view in FIG. 7, is of polyurethane material and corresponds approximately in size to that of the standard ice hockey puck used in the game of ice hockey which is 3 inches in diameter and one inch thick.

The puck body 12 is fabricated by molding and is provided with three openings 13 which extend through the body 12 of the puck from its planar end surfaces 14 and 16. The openings 13 are of uniform size and shape, being generally rectangular in cross section, and are symmetric with respect to the central axis 18 of the puck body and in equiangular spacing thereabout.

Figure 2:
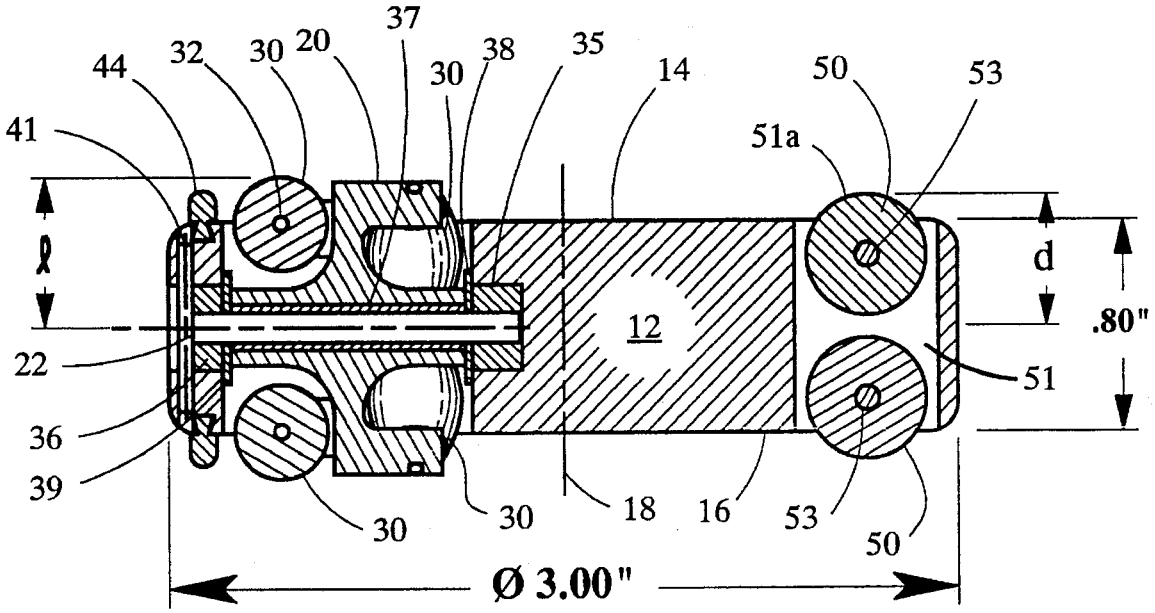
FIG. 2 is a view of the hockey puck of FIG. 1 as taken along the section line 2—2.
Figure 3:
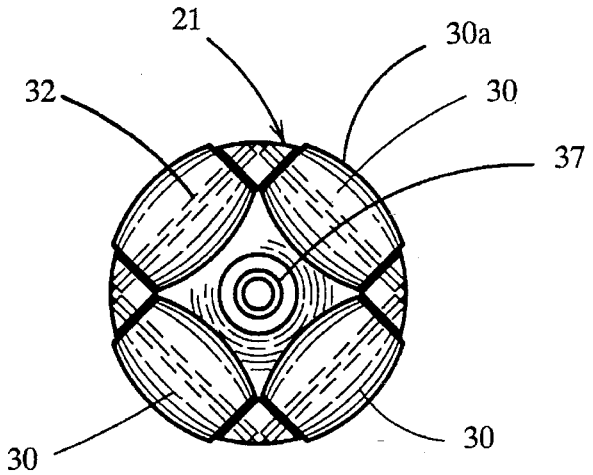
FIG. 3 is an end view of a multi-directional wheel assembly which is mounted in the puck body of the puck shown in FIG. 1.
Figure 4:
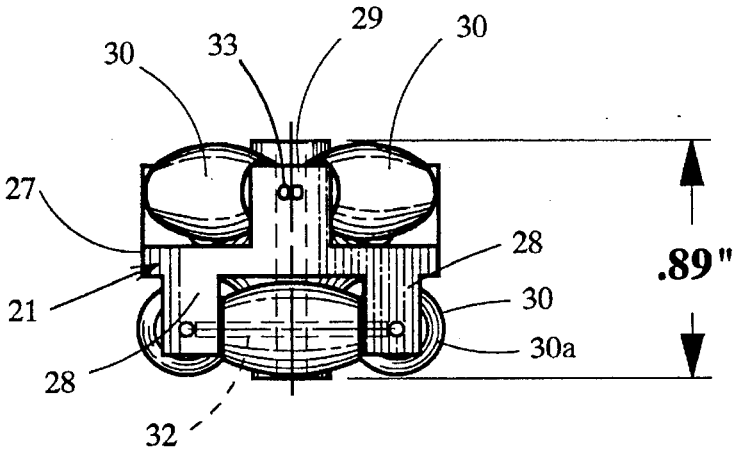
FIGS. 4 and 5 represent top and bottom views, respectively, of the wheel assembly of FIG. 3.
Figure 5:
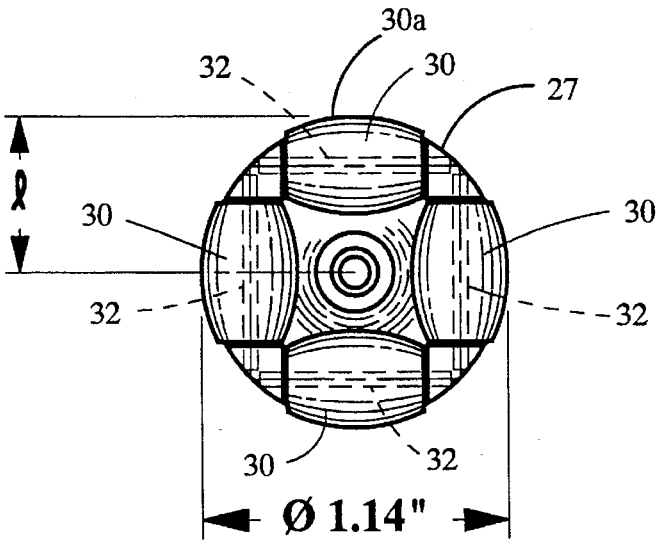
Figure 6:
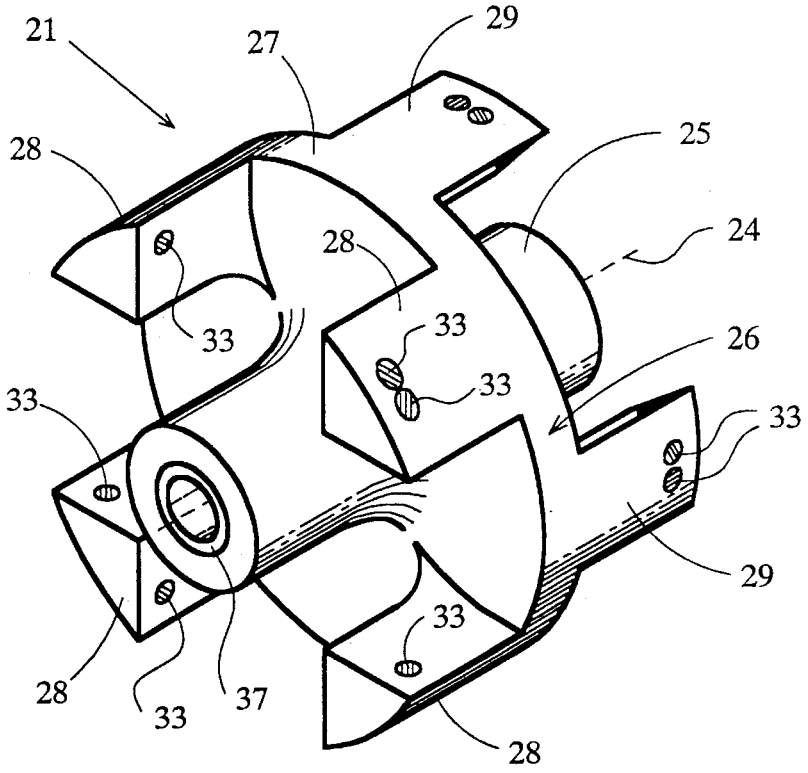
FIG. 6 is a view in perspective of the wheel support of the multi-directional wheel assembly of FIG. 3.

Within each of the openings 13 is mounted in a multi-directional wheel assembly 20. Each wheel assembly 20, as shown in FIGS. 1 and 2, comprises a wheel support body 21 mounted for rotation on a main axle 22 which extends in a radial direction from the axis 18 in a central plane parallel to the puck body planar surfaces 14 and 16. The wheel support body 21 shown in perspective view in FIG. 6, is formed symmetrically about a central axis 24 and comprises a central tubular shaft 25 which is sized to accommodate the main axle 22. It is also provided with a radial flange 26 formed intermediate the ends of the shaft 25. The flange 26 is provided with an outer surface 27 of circular cylinder configuration symmetric with respect to the axis 24 and with a diameter which is slightly larger than the thickness of the puck body such that the wheel support body 21 protrudes beyond the planar surfaces 14 and 16 when the puck is viewed edgewise as shown in FIG. 2.

The flange 26 is also provided with a first plurality of fingers 28 which project from one side of the flange 26 in the axial direction of the support body 21 and a second plurality of fingers 29, which project from the other side of the flange, also in the axial direction of the body 21.

In the preferred embodiment of the invention described herein, the fingers 28 are four in number and are formed in equiangular spacing about the central axis 24, which spacings are each sized to accommodate one of a set of four wheels 30. Each wheel 30 of the set is mounted for rotation on an individual axle 32 which is positioned perpendicular to the radial direction of the axis 24 and with its respective ends mounted in a pair of adjacent fingers 28, each of which is provided with bores 33 to accommodate the adjacent ends of two of the axles 32. The four axles 32 are mounted in co-planar relationship to one another in a plane which extends perpendicular to the axis 24 of the support body 21.

It is also to be noted that each wheel 30 is provided with a roller surface 30*a* which is curved in the axial direction of the wheel 30 and in a longitudinal cross section through the wheel 30 defines an arc of a circle with a radium of curvature "1" which is greater than the radius of the cylindrical surface 27. In a radial transverse section through the roller wheel 30, the surface 30*a* defines a circle.

It is also provided that each wheel assembly 20 comprises two sets of wheels 30 with a second set of four wheels mounted between the projecting flange fingers 29 on the opposite side of the flange 26. The second set of wheels 30 are mounted in similar fashion to the wheels on the fingers 28. Preferably, however, the fingers 29 are in an equiangular spaced relationship to one another such that each finger 29 extends in the axial direction of the support body 21 and is also in equiangular spaced relation to an adjacent pair 6f fingers 28 projecting from the other side of the flange 26.

Preferably, the main axle 22 is cushioned at one end by a bushing 35 seated in a blind bore in the puck body and it its other end by a bushing 36. The bushing 36 is press fit in an opening 34 which extends from the opening 13 to the outer cylindrical surface 23 of the puck body. The bushings 35 and 36 are preferably of cellular urethane, which is a more compliant and resilient material than the harder polyurethane used for the puck body 12. The greater compliancy of the bushings 35, 36 allow for attenuation of the vertical dynamic energy which is imposed on the puck as a result of its rapid movement over rough playing surfaces.

To further minimize rolling friction, a low-friction elongate bushing 37 is disposed in sleeved relationship to the main axle 22, and is press fit into the wheel support body 21. Washers 38, 39 are fitted on the axle 22 between the ends of the elongate bushing 37 and the cushion bushings 35, 36 respectively. To prevent the main axle 22 from sliding out of the puck, a series of small pins 41 are press fit in vertical bores 42 formed in the puck body near the peripheral cylindrical outer surface 27 of the puck and spaced such that at least one of the pins abuts the end of the axle 22 and all of the pins abut the outboard bushing 36.

It is to be noted that the design of the wheel support body 21 is selected to accommodate the maximum diameter possible for a wheel 30 in order to maximize rolling efficiency. The design, which also dictates more than one set of wheels per wheel assembly 20, insures that there is always at least one wheel which contacts the ground.

It is also to be noted that the main axles of the multi-directional wheel assemblies, although shown to be radial in the embodiment of the invention shown herein, could be mounted in any direction in a symmetrical orientation with respect to the central axis 18 of the puck.

When the puck body is tilted with respect to the playing surface the circular edges of the puck body will contact the playing surface and therefore these edges are rounded to minimize friction. However, to further reduce friction on the puck body when tilted, the puck body is provided near its circular edges with low-friction protrusions 44 which serve to prevent contact between the playing surface and the portion of the wheel support body 21 which is between each pair of outboard wheels 30 in an adjacent pair of roller wheel assemblies 20. Each protrusion 44 is an elongate member mounted in an accommodating groove 45 formed in the puck body closely adjacent the pin holes 42 and between the outer cylindrical surface 27 and an opening 13 and in similar perpendicular orientation with respect to a radius from the central axis of the puck. The protrusions 44, one provided adjacent each wheel assembly 20, have rounded edges for their upper surfaces and are made of high-durability plastic, such as acetal homopolymer, also known as DELRIN, which has a lower coefficient of friction than the puck body 12 and wheel support body 21 materials. The length of a protrusion 44, which is symmetrically positioned with respect to the adjacent series of pins 41, is limited in length such that it does not contact the playing surface except when the puck is tipped upward at its diametrically opposite edge.

Another feature which is provided to further minimize friction on the leading edge of travel of the puck body when the puck is tipped upward on its trailing edge portion, are a plurality of single-direction edge rollers 50 which are mounted in the puck body in openings 51 which extend through the puck body from top to bottom between its surfaces 14, 16. The openings 51 are located in equiangular spacing to one another near the outer peripheral surface 27 of the puck body, one such opening 51 being provided between each adjacent pair of multi-directional wheel assemblies 20. The rollers 50 are also made of the same low-friction high-wear material that characterizes the protrusions 44 and also the wheels 30.

As best seen in FIG. 2, there are two edge rollers 50 mounted in each puck body opening 51. Each roller 50 is provided with a cylindrical rolling surface 51*a* and is mounted on its own individual axle 53 which is press fit into the puck body through an access bore 54 in the puck body, there being two such access bores provided to accommodate two edge rollers 50 in each opening 51 with the bores each extending parallel to the puck surfaces 14, 16 but being in co-planar relationship with respect to one another in a plane perpendicular to the surfaces 14, 16. It will also be seen in FIG. 2, that the rolling surface of one edge roller 50 protrudes above the planar surface 14 of the puck body and the rolling surface of its companion roller 50, mounted therewith in the same opening 51, protrudes below the planar surface 16 when the puck is viewed edge-wise. At its farthest point, the roller surface 50*a* is a distance "d" from the central plane or axis 18 of the puck body, which distance is greater than its radius "1" of the wheel support body. In any event, the rollers 50 are sized in diameter such that they do not touch the playing surface when the puck is lying flat. The edge rollers 50 are adapted to contact the playing surface only while the puck is tipped up on its trailing edge and the leading edge is between an adjacent pair of multi-directional wheel assemblies 20.

It will therefore be seen that a novel type of hockey puck is described herein which is particularly suited for play on hard non-ice surfaces. In actual size it closely approximates the official hockey puck as is used in the game of ice hockey and through the provision of low-friction multi-directional wheel assemblies, its performance characteristics is superior to other hockey pucks designed for non-ice playing surfaces, particularly those which rely on ball rollers and skid-type contacting surfaces.

It is to be understood therefore that the foregoing description of a preferred embodiment of the invention has been presented for purposes of explanation and illustration and is not intended to limit the invention to the precise form disclosed. For example, the number of multi-directional wheel assemblies could be greater than three and such wheel assembly could comprise only one set of roller wheels. The main axles of the wheel assemblies could also be mounted in non-radial orientation with respect to the puck axis and the low-friction protrusions 44 might also be eliminated. The puck body could also be made of a material other than polyurethane provided it has similar impact strength and toughness. Accordingly, it is to be appreciated that many changes may be made in the precise structure of the hockey puck and the materials of which it is made by those skilled in the art without departing from the spirit of the invention.

We claim:

1. A hockey puck particularly adapted for use on a non-ice playing surface, said puck comprising:

a puck body of circular cylinder configuration having a pair of parallel planar end surfaces spaced to define the thickness of the puck, a circumferential circular cylinder edge surface, and a plurality of at least three openings which extend through the puck body between said planar surfaces, said plurality of openings being located in equiangular spacing about the cylinder axis of the puck body and at equal radial distances from said puck body axis;

a plurality of multi-directional wheel assemblies, each of which comprises a wheel support body mounted in a different one of said openings for rotation on an associated main axle which extends in a central plane parallel to said puck body planar surfaces, said wheel support body having an outer surface of cylindrical configuration defined about the main axle with a diameter which is slightly greater than the thickness of said puck body, each said wheel assembly further comprising two sets of wheels with four wheels to a set and wherein the four wheels of each set are each journalled for rotation on a different one of four wheel axles mounted in a plane perpendicular to the main axles of the wheel assembly and parallel to the plane defined by the axles of the companion set of wheels in the wheel assembly, each of said four wheel axles in a set being disposed parallel to another one of said wheel axles in the set and perpendicular to the other two of said wheel axles of the set, each wheel of a set having a curved roller surface which in a longitudinal cross section co-planar with the axes of all the wheels in the set describes the arc of a circle having a radius of curvature which with respect to said central plane is of a length l which slightly exceeds the radial distance of the cylindrical outer surface of the wheel support body from its associated main axle and is concentric with arcs described in said cross-section by the other roller surfaces of the set, said wheel assemblies thereby allowing a rolling action of at least one pair of wheels of a wheel assembly whenever a pushing force is applied to the puck body with a force component in any direction parallel to the playing surface.

2. A hockey puck as set forth in claim 1 wherein said puck body is further provided with a second plurality of openings which extend through the puck body between said planar surfaces near the circumferential edge of the puck body and in equiangular spacing about the center of the puck body, said second plurality of openings corresponding in number to said first plurality of openings with each of said second plurality of openings being located between a different pair of said multi-directional wheel assemblies; and multiple pairs of single-direction edge rollers, each pair of which is mounted in a different one of said second plurality of openings and each roller of each said pair being mounted on an associated axle located equidistant with the other edge rollers from said central plane and extending in a tangential direction of the puck body parallel to the axle of the other roller of said pair and such that a portion of its roller surface is at a greater distance d from said central plane than is the distance of the nearest adjacent planar end surface of the puck body from said central plane and wherein d is less than l whereby said edge rollers are adapted to minimize frictional force imposed on the leading edge of travel of said puck whenever the leading edge of the puck body is between a pair of said multi-directional wheel assemblies and the trailing edge of the puck body is tipped upwards.

3. A hockey puck as set forth in claim 2 wherein the roller surface of each said edge roller is of circular cylinder configuration.

4. A hockey puck as set forth in claim 1 wherein the main axles of the multi-directional wheel assemblies extend in a radial perpendicular direction from said puck axis.

5. A hockey puck particularly adapted for use on a non-ice playing surface, said puck comprising:

a puck body of circular cylinder configuration having a pair of parallel planar end surfaces spaced to define the thickness of the puck, a circumferential cylindrical edge surface, and a plurality of at least three openings which extend through the puck body between said planar surfaces, said plurality of openings being located in equiangular spacing about the cylinder axis of the puck body and at equal radial distances from said axis;

a plurality of multi-directional wheel assemblies, each of which comprises a wheel support body mounted in a different one of said openings for rotation on an associated main axle which extends in a central plane parallel to said puck body planar surfaces, said wheel support body having an outer surface of cylindrical configuration defined about its associated main axle with a diameter which is slightly greater than the thickness of said puck body, each said wheel assembly further comprising a plurality of wheels, each of which is journalled for rotation on an axle mounted on said wheel support body in a plane perpendicular to the main axle of the wheel assembly, each said wheel having a curved roller surface which in a longitudinal cross section co-planar with the axes of all the wheels in the wheel assembly describes an arc of a circle having a radius of curvature which with respect to said central plane is of a length which slightly exceeds the radial distance of the cylindrical outer surface of the wheel support body from its associated main axle and is concentric with arcs described in said cross-section by the other roller surfaces of the wheel assembly, said plurality of wheel assemblies thereby allowing a rolling action of at least one of the wheels of the wheel assemblies whenever a pushing force is applied to the puck body with a force component in any direction parallel to the playing surface.

6. A hockey puck as set forth in claim 5 wherein said outer surface of said wheel support body is of circular cylinder configuration.

7. A hockey puck as set forth in claim 5 wherein each main axle associated with a wheel support body extends in a radial perpendicular direction from said puck axis.

8. A hockey puck as set forth in claim 5 wherein said puck body is further provided with a second plurality of openings which extend through the puck body between said planar surfaces near the circumferential edge of the puck body and in equiangular spacing about the center of the puck body, said second plurality of openings corresponding in number to said first plurality of openings with each of said second plurality of openings being located between a different pair of said multi-directional wheel assemblies; and multiple pairs of single-direction edge rollers, each pair of which is mounted in a different one of said second plurality of openings and each roller of each said pair being mounted on an associated axle located equidistant with the other edge rollers from said central plane and extending in a tangential direction of the puck body parallel to the axle of the other roller of said pair and such that a portion of its roller surface is at a greater distant d from said central plane than is the distance of the nearest adjacent planar end surface of the puck body from said central plane and wherein d is less than 1 whereby said edge rollers are adapted to minimize frictional force imposed on the leading edge of travel of said puck whenever the leading edge of the puck body is between a pair of said multi-directional wheel assemblies and the trailing edge of the puck body is tipped upwards.

9. A hock puck as set forth in claim 8 wherein the roller surface of each said edge roller is of circular cylinder configuration.

* * * * *